US005597460A

United States Patent [19]

Reynolds

[11] Patent Number: 5,597,460

[45] Date of Patent: Jan. 28, 1997

[54] PLATING CELL HAVING LAMINAR FLOW SPARGER

[75] Inventor: H. Vincent Reynolds, Marcellus, N.Y.

[73] Assignee: Reynolds Tech Fabricators, Inc., East Syracuse, N.Y.

[21] Appl. No.: 556,463

[22] Filed: Nov. 13, 1995

[51] Int. Cl.[6] ..... C25D 17/02; C25D 17/12; C25D 21/06; C25D 21/10

[52] U.S. Cl. ..... 204/212; 204/224 R; 204/264; 204/273; 204/287; 204/283; 204/284; 204/238

[58] Field of Search ..... 204/275, 276, 204/264, 283, 279, 273, 284, 224 R, 212, 287, 263, 238

[56] References Cited

U.S. PATENT DOCUMENTS

| | | | |
|---|---|---|---|
| 3,763,027 | 10/1973 | Pearson | 204/224 R |
| 4,062,755 | 12/1977 | Turner | 204/284 X |
| 4,269,669 | 5/1981 | Soby et al. | 204/275 X |
| 4,372,825 | 2/1983 | Eidschun | 204/273 X |
| 4,391,694 | 7/1983 | Runsten | 204/273 |
| 4,431,500 | 2/1984 | Messing et al. | 204/206 |
| 4,696,729 | 9/1987 | Santini | 204/273 X |
| 5,217,536 | 6/1993 | Matsumura et al. | 204/276 X |
| 5,514,258 | 5/1996 | Brinket et al. | 204/297 R X |

*Primary Examiner*—Donald R. Valentine
*Attorney, Agent, or Firm*—Trapani & Molldrem

[57] ABSTRACT

A plating cell for plating a flat substrate, for example, a stamper for a high-density compact disk recording, employs an arcuate sparger to introduce a laminar flow of electrolyte across the surface of the substrate to be plated. In a preferred embodiment, the sparger occupies about 90 to about 120 degrees of arc. A semipermeable weir separates the main plating bath from an anode chamber that contains an anode basket that is filled with nuggets of nickel or other plating material. The plating cell is provided with a backwash flow regime so that impurities and inclusions from the anode chamber are kept out of the plating bath. The substrate can be positioned between vertical and about forty-five degrees from vertical, and can be supported with or without rotation.

11 Claims, 4 Drawing Sheets

PLATING CELL HAVING LAMINAR FLOW SPARGER

BACKGROUND OF THE INVENTION

This invention relates to electroplating cells, and is more particularly directed to an injection or sparger means which provides an even flow of electrolyte onto and across the substrate to be plated.

Electroplating plays a significant role in the production of many rather sophisticated technology products, such as masters and stampers for use in producing digital compact discs or CDs. However, as these products have become more and more sophisticated, the tolerances of the plating process have become narrower and narrower. For example, in a modem CD, any impurities or blemishes of one micron or larger can create unacceptable data losses. Current electroplating techniques can result in block error rates of 70, and with higher density recordings, the block error rate can be 90 or higher. Current plans to increase the data density of compact discs are being thwarted by the inability of plating techniques to control blemishes in the plating process.

A number of techniques for electro-depositing or coating on an article face been described in the patent literature, but none of these is able to achieve the high plating purity and evenness of application that are required for super-high density compact discs.

Andros et at. U.S. Pat. No. 4,376,031 describes electrophoretic coating apparatus in which a suspension of electrophoretic material is contained in a tank. In this apparatus a distribution manifold has a pair of discharge robes provided with a series of orifices to create a non-turbulent flow of the suspension.

Santini U.S. Pat. No. 4,696,729 is directed to an electroplating cell which has a channel formed between wall members to create an even, non-turbulent flow of the plating solution. In this scheme, the electrolyte passes through an isostatic chamber containing small spherical glass beads that are held in place by a screen-like membrane. The flow of the solution is in the direction across the surface of the workpiece.

Turner U.S. Pat. No. 4,062,755 relates to a sparging system for an electroplating cell, in which a plating chamber has a perforated partition, i.e. , with a series of slots, to create an upward flow of the plating solution.

Glenn U.S. Pat. No. 3,963,588 shows a slotted sparger for a high current density electroplating process. The sparger can have an elongated discharge port.

Lowe U.S. Pat. No. 2,181,490 relates to an electroplating set-up that employs elongated injection nozzles for distributing electrolyte to a circular substrate or workpiece.

Johnston U.S. Pat. No. 4,435,266 is directed to an electroplating arrangement for making stamper plates, with an injection tube that flows the electrolyte axially against the plated face of the substrate.

Faulkner U.S. Pat. No. 3,634,047 describes an electroplating technique, where a cone head is employed to maintain the velocity head of electrolyte that is pumped through a baffle box into the plating tank. The cone head member has two groups of outlet ports, with the ports being of progressively changing diameters, and an arrangement of baffle members are intended to create a constant pressure of the plating solution that flows across the workpiece.

Shibata U.S. Pat. No. 3,400,067 is directed to an electrolytic cell that has a guide slit for discharge of mercury at a uniform flow rate. This is achieved with a pattern of profiled holes which can be variable in geometry.

Ransey et al. U.S. Pat. No. 3,450,625 concerns an electroplating technique in which a foraminous screen separates a tank into anode and cathode compartments. The screen is typically metal cloth or fabric. Sludge accumulates in an accumulator behind the screen.

Thurber U.S. Pat. No. 2,487,399 concerns an electroplating apparatus in which there are separate anodic and cathodic cells separated by membranes. The apparatus includes anodic filtering and circulating. Three cells are involved, including a plating tank and two separate overflow tanks.

Holsinger U.S. Pat. No. 3,788,965 describes a set-up for refining metal ore by selective electroplating from a solution of the ore. An acid solution of the ore is separated from a basic solution by means of an inert permeable barrier.

None of these prior plating arrangements employed a laminar flow sparger or injection nozzle within the plating bath, and none of these has achieved even, laminar flow across the face of the substrate during the plating operation. None of these plating cells or baths have employed a backwash technique that carries the sludge and particulate impurities away from the article to be plated, and none of these techniques has been capable of producing a flat plated article of high tolerance, such as a high-density compact disc master or stamper.

In the manufacture of compact discs, there is a step that involves the use of a so-called stamper. The stampers are negative discs that are pressed against the material for the final discs to create an impression that becomes the pattern of tracks in the product compact discs.

Stampers are nickel and are electroformed. The stampers are deposited on a substrate that has the data tracks formed on it, and has been provided with a conductive surface, e.g., by sputter coating. Then the substrate is placed into a plating tank. The nickel is introduced in solution into the process cell so that it can be electrochemically adhered onto the substrate surface, using standard electroplating principles. Present industry standards require the stamper to have an extremely high degree of flatness, and where higher density storage is to be achieved, the flatness tolerance for the nickel coating becomes narrower and narrower.

The flow regime for the plating solution within the tank or cell is crucial for successful operation. Flow regime is affected by such factors as tank design, fluid movement within the process vessel, distribution of fluid within the vessel and at the zone of introduction of the solution into the vessel, and the uniformity of flow of the fluid as it is contacts and flows across the substrate in the plating cell.

Present day electroplating cells employ a simple technique to inject fluid into the process vessel or cell. Usually, a simple pipe or tube is used with an open end that supplies the solution into the tank or cell. The solution is forced from the open end of the pipe. This technique is not conducive to producing a flat coating, due to the fact that the liquid is not uniformly distributed across the surface of the workpiece. This technique can create high points and low points in the resulting plated layer, because of localized eddies and turbulences in the flow regime.

Other problems frequently arise from the presence of impurities that are included within the anode material. That is, the lumps or nuggets of nickel that are contained in the anode typically contain some oxides and other impurities. As the nickel material is consumed, impurities accumulate as sludge within the anode chamber. During the plating process, particles of the sludge tend to migrate to the cathode side and can contaminate the plating on the substrate. Typically the anode material is contained in a cloth anode bag which is intended to hold the sludge as the material is consumed. However, the bag is unable to contain particles of micron size, which can damage the tracks of the CD stamper.

OBJECTS AND SUMMARY OF THE INVENTION

It is an object of the this invention to improve the flow regime of a plating cell, and in particular to permit the plating process to achieve coatings of high uniformity across the surface of a substrate.

It is a further object to provide a plating bath that includes a sparger or electrolyte injection means that achieves uniform, laminar flow across the face of the substrate during plating.

It is another object to provide a backflow arrangement for the plating cell that carries away and filters out contaminate particles and also promotes even flow of plating solution onto the substrate or workpiece to be plated.

It is a more specific object to provide a backflow technique that carries all contaminate particles away from the anode so that no sludge accumulates, and filters the contaminate particulate matter from the plating solution, while facilitating even distribution of the electroplating solution across the face of the substrate.

In accordance with an aspect of the present invention, an electroplating cell is provided for plating a substrate with a metal layer, e.g., to create a nickel stamper for producing compact discs. In the plating cell, a plating bath contains the electrolyte or plating solution, in which the substrate to be plated is submerged in the solution. A sparger or equivalent injection means introduces the solution into the plating bath and forms a laminar flow of the electrolyte or plating solution across the surface of the substrate to be plated. Adjacent the plating bath is an anode chamber in which anode material is disposed, with the material being contained within an anode basket. In a typical CD-stamper forming process, the anode material is in the form of chunks or nuggets of nickel, which are consumed during the plating process. A weir separates the plating bath from the anode chamber, and permits the plating solution to spill over its top edge from the plating bath into the anode chamber. The weir is in the form of a semipermeable barrier that permits nickel ions to pass through from the anode chamber into the plating bath, but blocks passage of any particulate matter.

In one preferred arrangement, the anode basket is provided with perforations on all sides so that any inclusions, oxides or other particles in the nickel lumps will pass out and not accumulate as sludge. A drain outlet is located at the bottom of the anode chamber. A circulation system is coupled to the drain outlet to draw off the solution from the anode chamber, together with any entrained particles, and to feed the solution through a microfilter so that all the particles of microscopic size or greater are removed from the plating solution. Then the filtered solution is returned to the sparger and is re-introduced into the plating cell. In this way a backwash of the plating solution is effected, so that the flow regime of the fluid itself washes any particulates out of the anode chamber in the direction away from the plated article. At the same time, the cleansed and purified solution bathes the plated surface of the substrate as a uniform, laminar flow of solution, thus avoiding any high spots or voids during plating. As a result, very high tolerance is achieved, permitting production of compact disks of extreme density without significant error rates.

The flow regime is further improved by the geometry of the well that forms the tank for the plating bath. The substrate can be positioned on either a fixed or rotary mount. The latter typically rotates, e.g. at 45–50 RPM The substrate can be oriented anywhere from vertical to about 45 degrees from vertical. The well is formed with a generally cylindrical wall that is coaxial with the axis of the substrate. This arrangement avoids corners and dead spaces in the plating cell, where either the rotation of the substrate or the flowing movement of the plating solution might otherwise create turbulences. Also, this minimizes the volume of the plating bath, which facilitates process control of the plating cell.

The laminar flow sparger is shaped to fit on the lower wall of the plating bath or plating cell, and is positioned adjacent the base of the weir to flow the solution into the space defined between the substrate and the weir. The sparger includes a hollow body that defines a plenum, and which has an upper wall that contains a series of flow holes. The flow holes are arranged to create a uniform, laminar flow of the electrolyte across the planar face of the substrate. In the preferred embodiment, the well of the plating cell has a cylindrical bottom wall or floor, and the sparger has an elongated arcuate shape to fit onto this generally cylindrical wall. The bores or flow holes in the sparger are preferably disposed with axes that are parallel with one another to define the flow direction of the plating solution. In the preferred embodiments the flow hole axes are oriented generally upwards and parallel to the face of the plated substrate. The sparger should be coextensive with the geometry of the plated substrate, and in practice should cover an arc of between about ninety and about one-hundred-twenty degrees.

The above and many other objects, features, and advantages of the invention will become apparent from the ensuing description of a preferred embodiment thereof, which should be read in conjunction with the accompanying Drawing.

DETAILED DESCRIPTION OF THE PREFERRED EMBODIMENT

Figure 1:
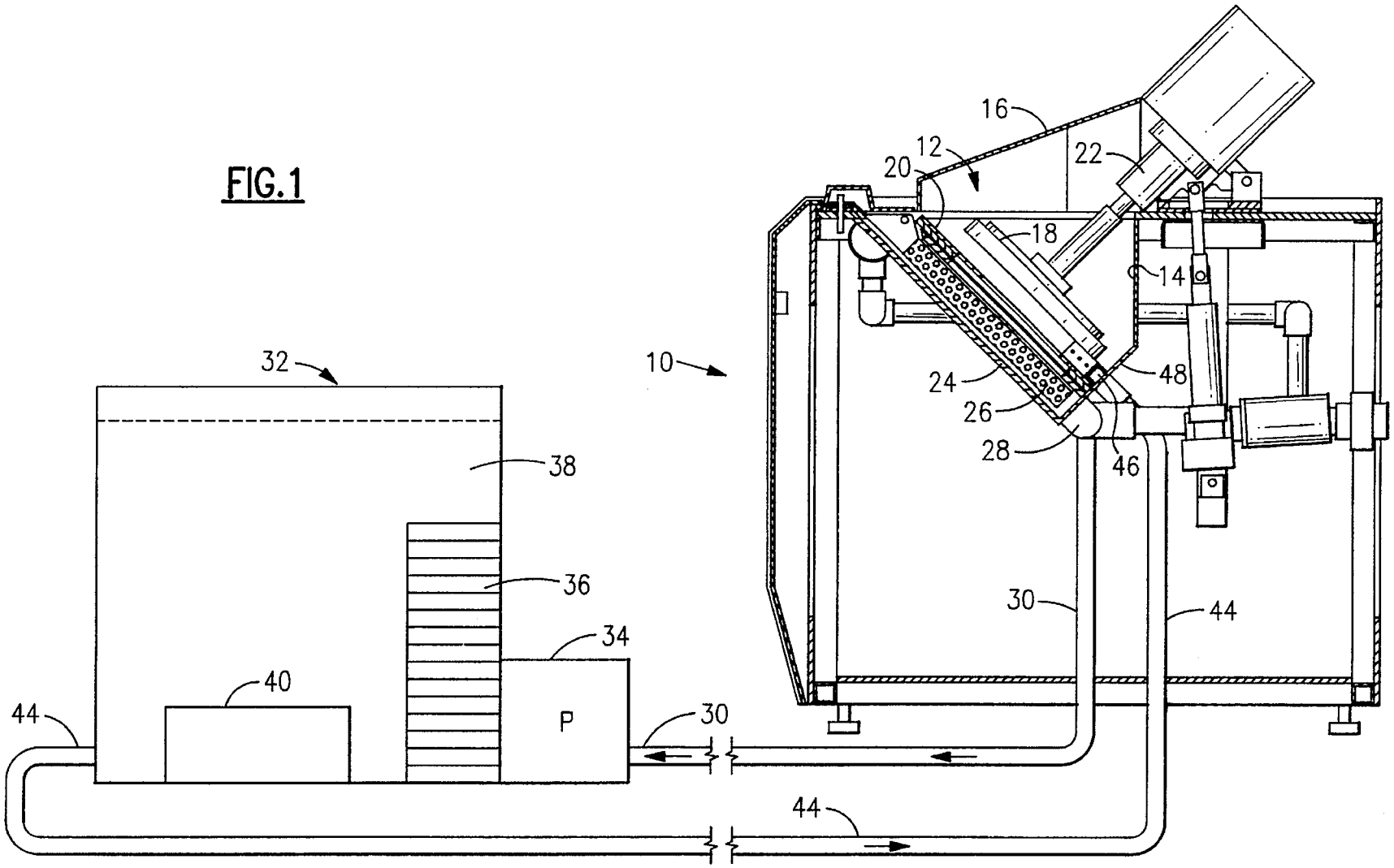
FIG. 1 is a schematic elevational view of a plating cell and reservoir assembly according to one embodiment of the present invention.
Figure 2:
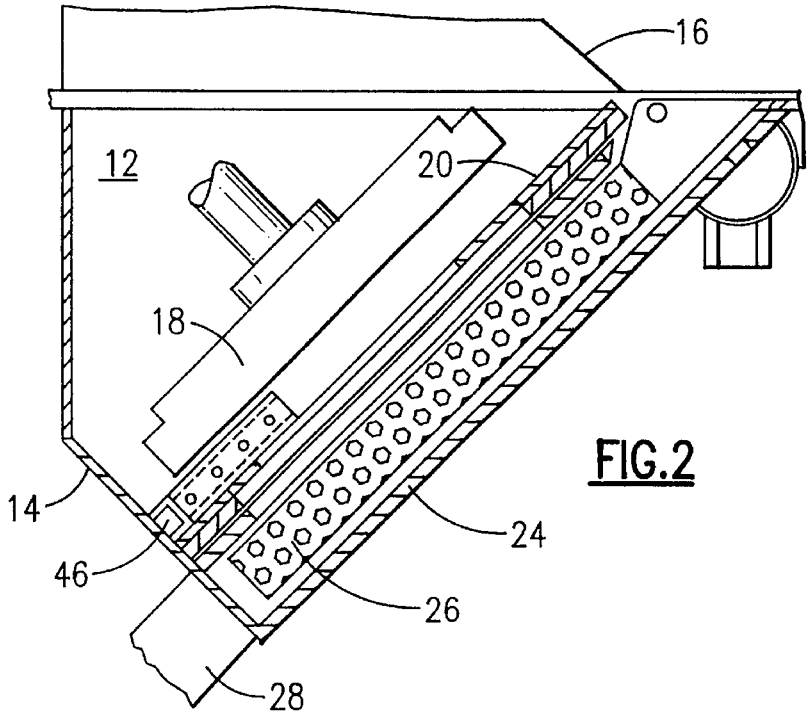
FIGS. 2 and 3 are a front view and a side view, respectively, of the plating cell featuring the laminar flow sparger according to this embodiment of the invention.
Figure 3:
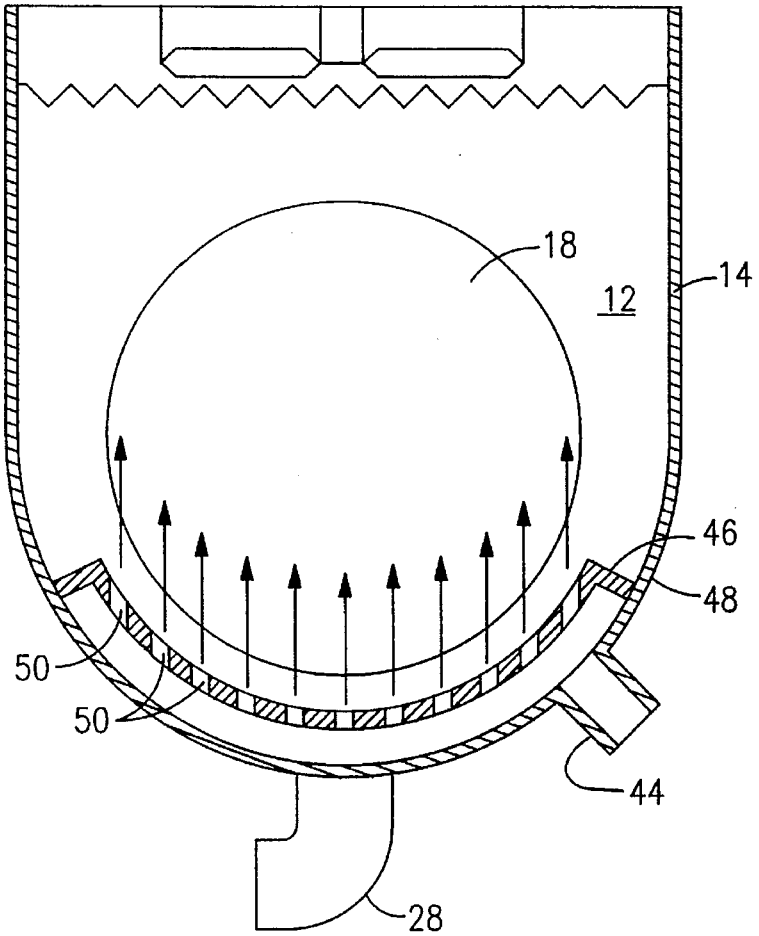

With reference to the Drawing, and initially to FIGS. 1 to 3, a plating assembly for plating stampers for compact discs or the like is shown to comprise a plating cell 10, formed of a suitable acid-resistant material, e.g. polypropylene. A plating bath 12 is located in a well 14 at the top of the cell, and in operation a cover 16 closes over the well 14. A generally circular substrate 18, which here for example is to create a stamper for a compact disc forming process, is immersed in the plating bath 12 and is disposed a short distance from a forward wall or weir 20 at the front end of the plating bath 12. In this embodiment, a rotary mount 22 positions the substrate and rotates it at a predetermined speed. e.g., 45 to 50 RPM, within the plating bath 12. The weir 20 includes a semipermeable barrier that separates the main plating bath 12 from an anode chamber 24. In the anode chamber an anode basket 26 contains lumps of nickel (or other metal to be plated). Electrolyte from the plating bath 12 spills over an upper edge of the weir 20 into the chamber 24, and passes out via a drain outlet 28 at the bottom of the anode chamber 24. The electrolyte fluid passes through an outlet pipe 30 to a reservoir 32, shown schematically at the left side of FIG. 1. In practice a single reservoir can serve several plating cells.

The flow direction carries any impurity particles and sludge from the plating cell out through the outlet drain, so that the particles will not contact and contaminate the plated nickel on the substrate 18. The reservoir has a pump 34 that pumps the fluid through a microscopic filter 36 into a holding tank 38. The tank contains heat management equipment 40 that maintains the temperature of the electrolyte within predetermined temperature limits. The equipment 40 can add or remove heat, as necessary. A return tube 44 returns the filtered, heat-controlled electrolytic fluid to the plating cell, where it is injected into the bath 12 via an arcuate laminar-flow sparger 46.

The weir 20 permits transfer of metal ions across into the plating bath 12, but stands as a barrier to any particulate matter, so that impurities can be carried only in the direction out the outlet drain 28 and towards the filter 36. The well 14 has a curved shape, with a generally cylindrical wall 48 and then a conic wall, considered in the direction of the axis of the rotary mount 22 and substrate 18. This serves to minimize the amount of fluid required in the bath 12, and also eliminates any comers or dead spaces where rotation of the substrate 18 could produce turbulence. The sparger 46 is mounted in the cylindrical wall 48 adjacent the weir 20 so that an upward laminar flow of the electrolyte occurs in the space defined between the front face of the substrate 18 and the weir 20. As shown in FIGS. 2 and 3, the sparger 46 has a row of through holes 50, which are oriented parallel to one another and generally upwards so as to direct an upward laminar flow of the electrolyte solution in the space between the substrate 18 and the weir 20. Here, a single row of holes 50 is shown, but in practice there could be two or more parallel rows. The sparger 46 is at least coextensive with the surface of the substrate to be plated, and should occupy about 90 to about 120 degrees of arc. In this embodiment, the sparger 46 is approximately square in cross section, but the cross sectional shape is not critical.

The weir, cover, pipes, and well are formed of polypropylene, or of another suitable corrosion-resistant material. Although not illustrated here, means are provided to apply controlled electrical current between the anode and the substrate, which serves as cathode. The sparger 46 washes the solution evenly across the substrate 18, which is submerged in the bath 12 so that its entire working surface is contacted with this even flow of fresh electrolytic fluid. As also shown here, the excess fluid spills over the weir 20 into the anode chamber 24. The flow of fluid passes downward and out the outlet fitting 28, carrying with it any impurities and contaminate particles that have emerged from the anode basket 26. At the same time the metal ions pass through the semipermeable wall of the weir 20, as indicated by an arrow, into the main bath 12.

Figure 5:
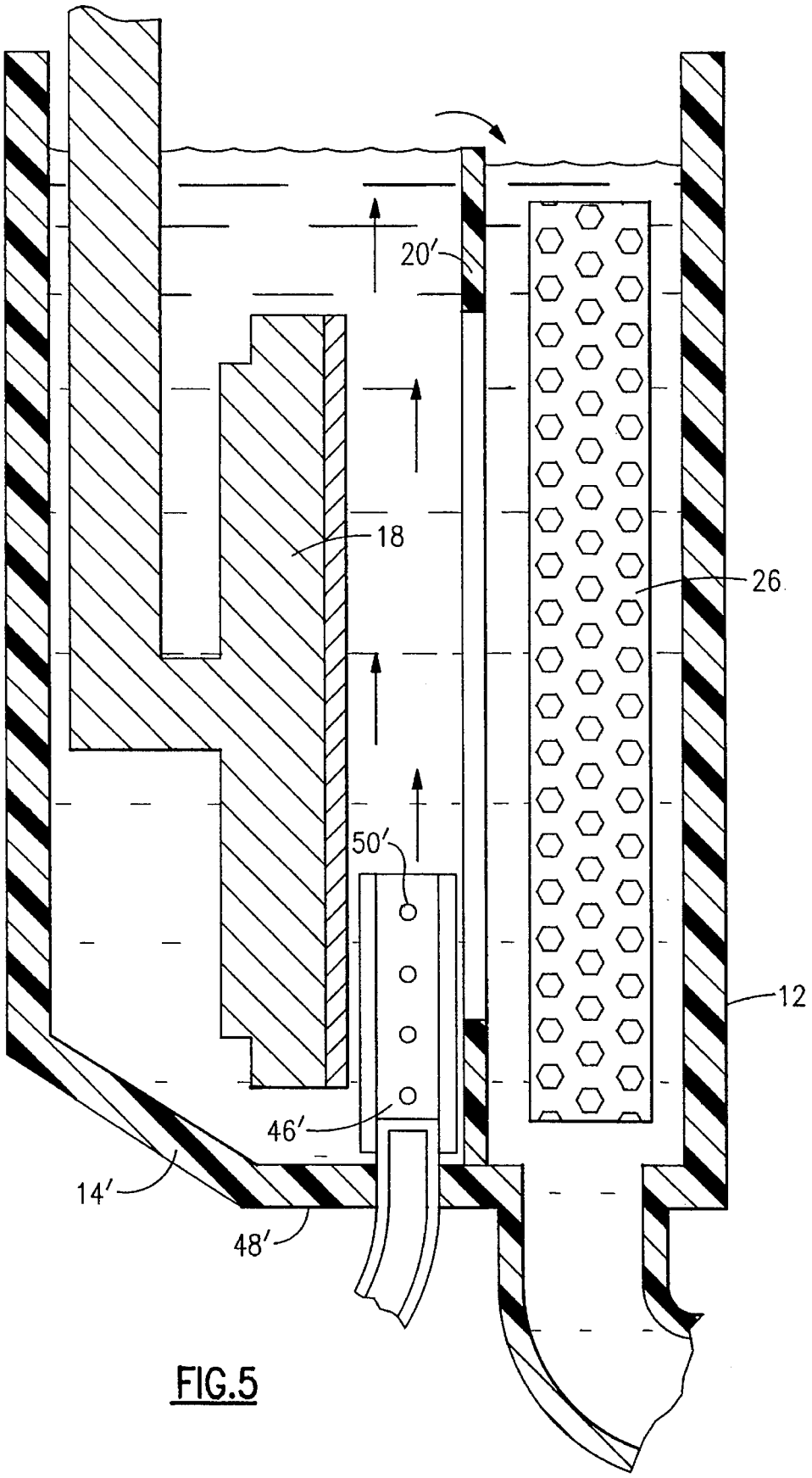
FIG. 5 is a side view of an alternate configuration according to this invention, in which the plated substrate can be oriented vertically.

An alternative construction of the plating bath of this invention is shown in FIG. 5, in which similar elements are identified with the same reference numbers as used in respect to the previously described embodiment. Where the part or element has been changed, the number is primed. Here, the substrate 18 is positioned on a non-rotational mount 22' and is oriented vertically in the plating bath 12'. The arcuate sparger 46' is positioned on the generally cylindrical wall 48' of the well 14' between the front surface of the substrate 18 and the weir 20'. Because the sparger 46' generates an extremely laminar flow of the electrolyte solution, it is unnecessary to rotate the substrate 18 during plating. The length dimension of the bath 12 can also be reduced, which reduces the volume of the bath, and increases the degree of control over plating conditions. In practice, the substrate can be oriented at any angle between vertical and about forty-five degrees.

Figure 6:
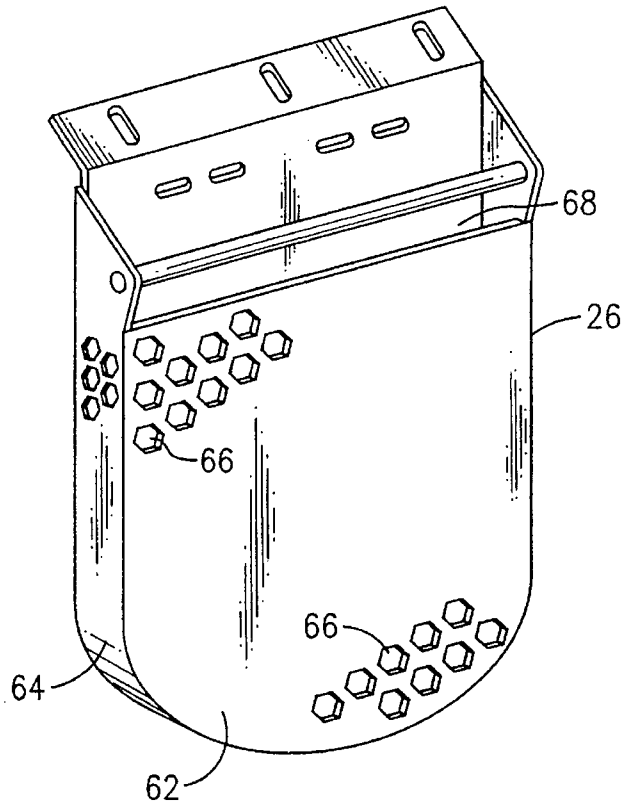
FIG. 6 is a perspective view of an anode basket that is employed in an embodiment of the present invention.
Figure 4:
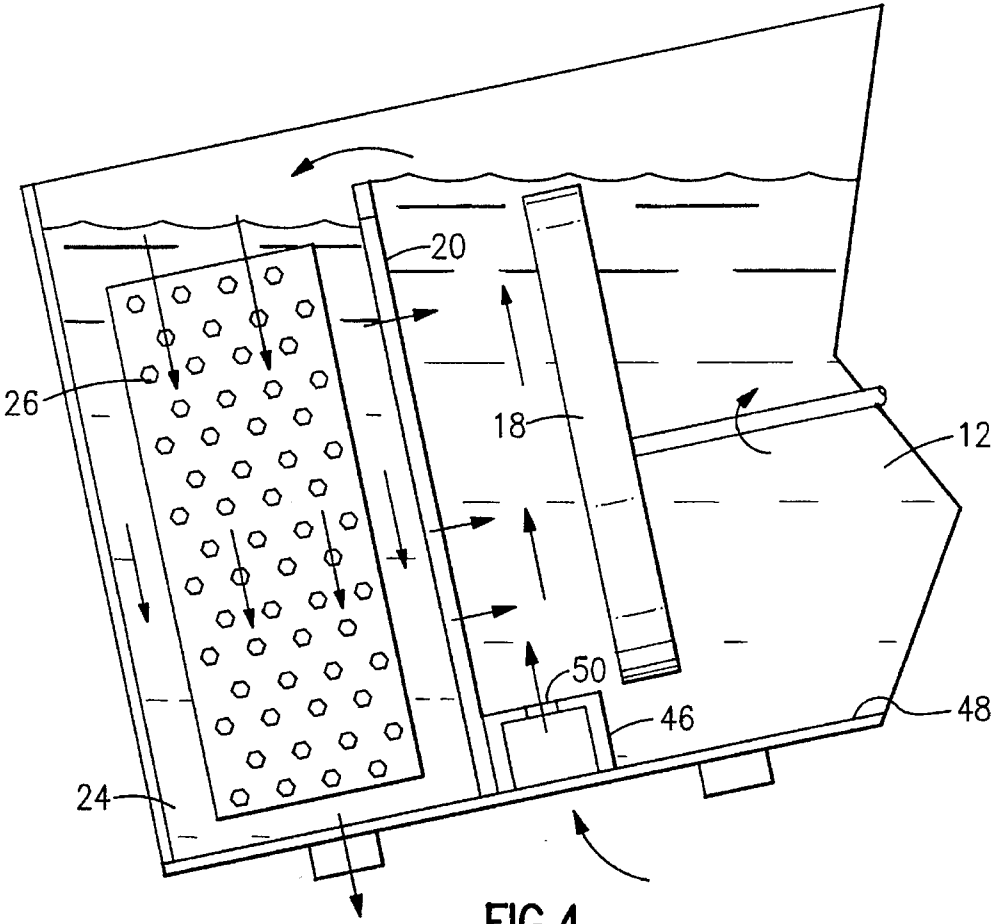
FIG. 4 is a schematic view for explaining the plating solution flow regime according to the present invention.

A preferred construction of the anode basket 26 is shown in FIG. 6. Here the basket has a perforated front wall 62 and a similar perforated rear wall, as well as a curved wall 64 that forms sides and a rounded bottom. Both the basket 28 and the anode chamber 26 have arcuate bottom sides. The drain outlet fitting 30 is located at the lowest point, i.e., at the center of the anode chamber bottom wall, so that all sediment will drift into the drain outlet and be entrained away with the exiting plating solution. All of the surfaces of the front, back, side and bottom walls are covered with hexagonal perforations. This maximizes the amount of open area on all sides, so that at least 51% of the walls are open. This permits impurities, oxides, inclusions and any other sediment from the nickel lumps or nuggets to pass through the basket and be carried out to the filter in the reservoir. In practice, round openings could be used rather than the hexagonal openings 66. As also shown in FIG. 6, the basket 26 has a front lip 68 that allows the electrolyte that spills over the weir 24 to enter and wash through the basket 28.

The plating cell of this invention, with the arcuate sparger 46 and the backwash flow regime, allows for the uniform injection of process solution of high purity across the face of the workpiece which is being electroformed. This arrangement also allows for the even distribution along the entire length of the distribution slot. With the laminar flow sparger, the even distribution that is achieved produces a plating of extremely high flatness to within a high tolerance. This permits stampers to be produced for extremely high data record densities with remarkably low block error rates.

Also, with the flow regime that is achieved with this invention, the traditional valving and distribution plates can be eliminated.

While this invention has been described in detail with reference to a preferred embodiment, it should be recognized that the invention is not limited to that embodiment. Rather, many modifications and variations will become apparent to persons of skill in this art without departing from the scope and spirit of the invention, as defined in the appended claims.

I claim:

1. An electroplating cell in which a planar lace of a substrate may be plated with a metal layer, wherein a plating bath is adapted to contain an electrolyte in which said substrate is immersed, said electroplating cell having holder means for holding said substrate in position in said plating bath, sparger means for introducing the electrolyte into the bath, an anode chamber in which an anode is disposed for containing a quantity of metal that is consumed during plating, a weir for separating said anode chamber from said bath and permitting the electrolyte to spill over from the bath into the anode chamber, said weir including semipermeable barrier means permitting metal ions to pass through from the anode chamber into said plating bath but blocking passage of any liquid or particulate matter, drain outlet means located in said anode chamber for carrying electrolyte and any entrained particulate matter from the anode chamber, and means for coupled between the drain outlet and the sparger means for removing any particulate matter from said electrolyte and for returning the electrolyte to said sparger means wherein said sparger means is adapted to establish a flow regime for said electrolyte in which fresh electrolyte is introduced through said sparger means into said plating bath, said electrolyte flows past said substrate and spills over said weir into said anode chamber, and said electrolyte exits said chamber out said drain outlet; and wherein said sparger means includes a hollow body defining a plenum, said hollow body being shaped to fit against a lower wall of said plating bath, including an upper wall over said plenum containing a series of flow holes such that said sparger means produces a uniform, parallel laminar flow of said electrolyte across the planar face of the substrate when on said holder means.

2. An electroplating cell according to claim 1 wherein said substrate is a master on which a stamper for a compact disc is formed, and said holder means includes a rotary mount on which said substrate may be held in said bath.

3. An electroplating cell according to claim 2 said mount further including means for rotating said substrate within said bath.

4. An electroplating cell in which a planar face of a substrate may be plated with a metal layer, wherein a plating bath is adapted to contain an electrolyte in which said substrate may be immersed, said electroplating cell having holder means for holding said substrate in position in said plating bath, wherein said holder means comprises a rotary mount on which said substrate may be held in said bath, sparger means for introducing the electrolyte into the bath, an anode chamber in which an anode is disposed for containing a quantity of metal that is consumed during plating, a weir separates said anode chamber from said bath and permits the electrolyte to spill over from the bath into the anode chamber, said weir including semipermeable barrier means permitting metal ions to pass through from the anode chamber into said plating bath but blocking passage of any particulate matter, drain outlet means located in said anode chamber for carrying electrolyte and any entrained particulate matter from the anode chamber, and means coupled between the drain outlet and the sparger means for removing any particulate matter from said electrolyte and returning the electrolyte to said sparger means; comprising the improvement wherein said sparger means includes a hollow body defining a plenum, said hollow body being shaped to fit on a lower wall of said plating bath, including an upper wall over said plenum containing a series of flow holes such that said sparger means produces a uniform laminar flow of said electrolyte across the planar face of said substrate, wherein said plating bath includes a well for retaining said electrolyte and said well has a generally cylindrical wall coaxial with said rotary mount such that dead spaces are avoided in which rotation of the substrate could produce turbulence.

5. An electroplating cell in which a planar face of a substrate may be plated with a metal layer, wherein a plating bath is adapted to contain an electrolyte in which said substrate is immersed, holder means holds said substrate in a predetermined position in said plating bath, sparger means introduce the electrolyte into the bath, an anode chamber in which an anode is disposed contains a quantity of metal that is consumed during plating, a weir separates said anode chamber from said bath and permits the electrolyte spill over from the bath into the anode chamber, said weir including semipermeable barrier means permitting metal ions to pass through from the anode chamber into said plating bath but blocking passage of any particulate matter, drain outlet means located in said anode chamber carry electrolyte and any entrained particulate matter from the anode chamber, and means coupled between the drain outlet and the sparger means remove any particulate matter from said electrolyte and return the electrolyte to said sparger means; comprising the improvement wherein said sparger means includes a hollow body defining a plenum, said hollow body being shaped to fit on a lower wall of said plating bath, including an upper wall over said plenum containing a series of flow holes such that said sparger means produces a uniform laminar flow of said electrolyte across the planar face of said substrate; wherein said plating bath includes a well for retaining said electrolyte and said well has a generally cylindrical wall coaxial with said substrate such that dead spaces are avoided which could produce turbulence in the plating bath.

6. An electroplating cell according to claim 5 wherein said hollow body of said sparger means is arcuate in shape to fit onto said generally cylindrical wall of said well.

7. An electroplating cell according to claim 6 wherein said flow holes are bores of with axes that are parallel with one another to define a flow direction.

8. An electroplating cell according to claim 6 wherein said weir and said holder means are positioned so that the weir and the planar face of the substrate on said holder are disposed at an angular orientation between vertical and forty-five degrees from vertical.

9. An electroplating cell according to claim 6 wherein said arcuate hollow body of said sparger means extends for about ninety to about one hundred twenty degrees of arc.

10. An electroplating cell in which a planar face of a substrate may be plated with a metal layer, wherein a plating bath is adapted to contain an electrolyte in which said substrate may be immersed, said electroplating cell having holder means for holding said substrate in position in said plating bath, sparger means for introducing the electrolyte into the bath, an anode chamber in which an anode is disposed and which contains a quantity of metal that is consumed during plating, a weir separates said anode chamber from said bath and permits the electrolyte 19 spill over from the bath into the anode chamber, said weir including semipermeable barrier means permitting metal ions to pass through from the anode chamber into said plating bath but blocking passage of any liquid or particulate matter, drain outlet means located in said anode chamber for carrying electrolyte and any entrained particulate matter from the anode chamber, and means coupled between the drain outlet and the sparger means for removing any particulate matter from said electrolyte and returning the electrolyte to said sparger means; comprising the improvement wherein said sparger means includes a hollow body defining a plenum, said hollow body being shaped to fit against a lower wall of said plating bath, including an upper wall over said plenum containing a series of flow holes such that said sparger means produces a uniform laminar flow of said electrolyte across the planar face of said substrate, wherein said sparger means is disposed adjacent said weir so as to generate said laminar flow into the space defined between said weir and the planar face of the substrate when on said holder.

11. An electroplating cell in which a planar face of a substrate may be plated with a metal layer, wherein a plating bath is adapted to contain an electrolyte in which said substrate may be immersed, said electroplating cell having holder means for holding said substrate in position in said plating bath, sparger means for introducing the electrolyte into the bath, an anode chamber in which an anode is disposed and containing a quantity of metal that is consumed during plating, a weir separates said anode chamber from said bath and permits the electrolyte to spill over from the bath into the anode chamber, said weir including semipermeable barrier means permitting metal ions to pass through from the anode chamber into said plating bath but blocking passage of any particulate matter, drain outlet means located in said anode chamber for carrying electrolyte and any entrained particulate matter from the anode chamber, and mean coupled between the drain outlet and the sparger means for removing any particulate matter from said electrolyte and returning the electrolyte to said sparger means; comprising the improvement wherein said sparger means includes an arcuate hollow body defining a plenum that extends for about ninety to about one hundred twenty degrees of arc, said hollow body being shaped to fit on a lower wall of said plating bath, including an upper wall over said plenum containing a series of flow holes having axes that are substantially parallel such that said sparger means produces a uniform laminar flow of said electrolyte across the planar face of said substrate.

* * * * *